United States Patent [19]

Wiersma

[11] 4,021,013

[45] May 3, 1977

[54] BOOK HOLDING DEVICE

[75] Inventor: Alva J. Wiersma, Denver, Colo.

[73] Assignee: The Raymond Lee Organization, Inc., New York, N.Y.; a part interest

[22] Filed: May 3, 1976

[21] Appl. No.: 682,616

[52] U.S. Cl. ..... 248/453; 240/6.4 B; 245/441 C

[51] Int. Cl.[2] ..... F21V 33/00

[58] Field of Search ..... 248/441 C, 445, 451, 248/453; 240/6.4 B

[56] References Cited

UNITED STATES PATENTS

| | | | |
|---|---|---|---|
| 284,228 | 9/1883 | Pickering | 248/453 |
| 1,483,396 | 2/1924 | Terrell | 248/451 |

FOREIGN PATENTS OR APPLICATIONS

| | | | |
|---|---|---|---|
| 1,518,012 | 2/1968 | France | 248/445 |
| 419,316 | 11/1934 | United Kingdom | 248/445 |

*Primary Examiner*—William H. Schultz
*Attorney, Agent, or Firm*—Daniel Jay Tick

[57] ABSTRACT

A plate-like support member of rectangular configuration has a surface, a first pair of parallel edges and a second pair of parallel edges perpendicular to and shorter than the first pair of edges bounding the surface. A mounting device is swivelly affixed to the support member at an upper of the first pair of edges and swivelly affixed to the headboard of a bed for adjustably selectively positioning the support member relative to the headboard. A ledge extends from the surface of the support member along a lower of the first pair of edges and has a first ledge surface parallel to and spaced from the surface of the support member and a second ledge surface perpendicular to the surface of the support member and extending from the surface to the first ledge surface for supporting a book resting on the support member in open position. Cover clamps are mounted on the support member at the second pair of edges thereof for releasably retaining the covers of the book in abutment with the surface of the support member.

2 Claims, 5 Drawing Figures

BOOK HOLDING DEVICE

BACKGROUND OF THE INVENTION:

The present invention relates to a book holding device. More particularly, the invention relates to a book holding device for a bed having a headboard.

Objects of the invention are to provide a book holding device of simple structure, which is inexpensive in manufacture, used with facility and convenience, mounted on the headboard of a bed with facility, convenience and without the need for tools, adjustable to any desired position with facility and convenience, and functions efficiently, effectively and reliably to support a book in open position at any desired page and thereby enable a person lying or sitting in bed to read the book without difficulty.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
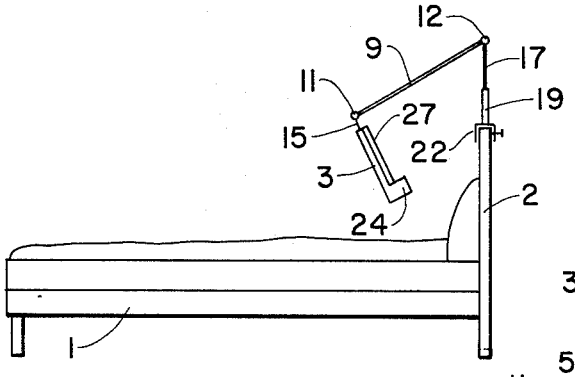
FIG. 1 is a side view of an embodiment of the book holding device of the invention mounted on a bed.
Figure 2:
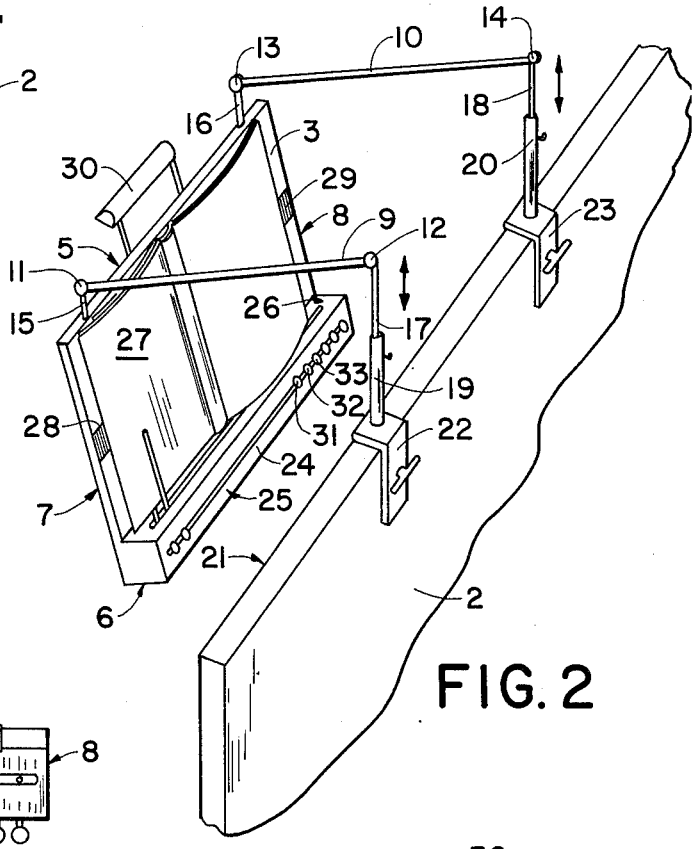
FIG. 2 is a perspective view, on an enlarged scale, of the embodiment of FIG. 1, mounted on a bed.

The book holding device of the invention is for a bed 1 having a headboard 2 (FIGS. 1 and 2).

The book holding device of the invention comprises a substantially plate-like support member 3 of substantially rectangular configuration having a surface 4 (FIGS. 3 to 5), a first pair of substantially parallel edges 5 and 6 (FIGS. 2 and 5) and a second pair of substantially parallel edges 7 and 8 (FIGS. 2, 3 and 5) substantially perpendicular to, and shorter than, the first pair of edges, bounding the surface.

Figure 3:
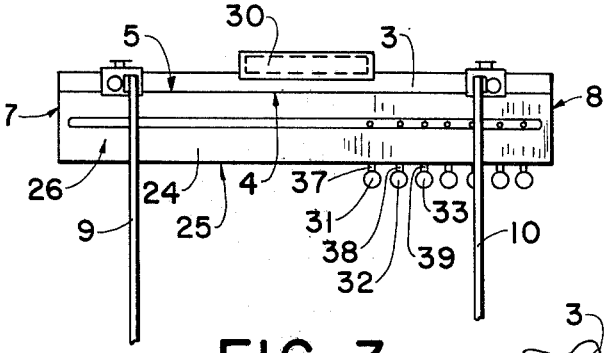
FIG. 3 is a top view, on an enlarged scale, of part of the embodiment of FIGS. 1 and 2.
Figure 5:
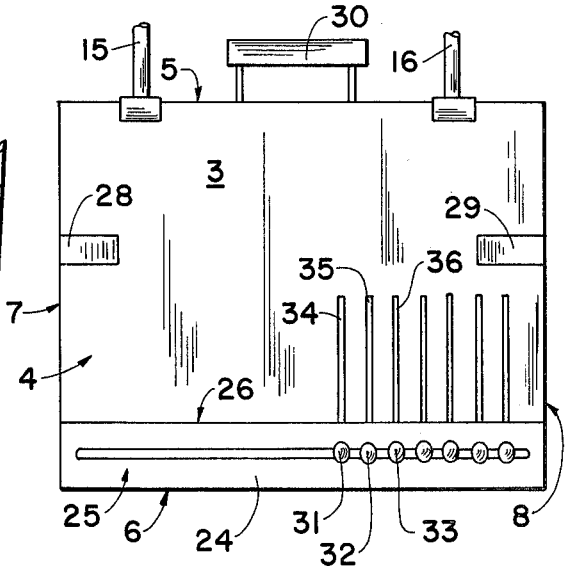
FIG. 5 is front view of the part shown in FIG. 3.

A mounting device is swivelly affixed to the support member 3 at an upper 5 of the first pair of edges, as shown in FIGS. 2, 3 and 5, and swivelly affixed to the headboard 2 of the bed 1 for adjustably selectively positioning the support member relative to the headboard.

As shown in FIGS. 1 and 2, the mounting device comprises a pair of spaced support rods 9 and 10. The support rods 9 and 10 have universal joints 11 and 12, and 13 and 14, respectively, at their opposite ends. The universal joints 11 and 13 are affixed to a pair of support rods 15 and 16 which are affixed, at their opposite ends, to the upper edge 5 of the support member 3. The universal joints 12 and 14 are affixed to support rods 17 and 18, respectively, which are movably mounted in tubular support members 19 and 20, respectively, for adjustment in upright positions.

The tubular support members 19 and 20 are affixed to the top edge 21 of the headboard 2 in spaced relation with each other via C clamps 22 and 23, respectively, affixed thereto. The universal joints 11 to 14 are relatively high friction joints so that manual force must be utilized to position the support rods and, once such rods are positioned, they are retained in position by the high coefficient of friction between the parts of the universal joints.

A ledge 24 extends from the surface 4 of the support member 3 along a lower 6 of the first pair of edges and has a first ledge surface (FIGS. 2 to 5) substantially parallel to, and spaced from, said surface of said support member. The ledge 24 has a second ledge surface 26 (FIGS. 2 to 5) substantially perpendicular to the surface 4 of the support member 3 and extending from said surface of said support member to the first ledge surface 25 for supporting a book 27 (FIGS. 1 and 2) resting on the support member in open position.

A pair of cover clamps 28 and 29 (FIGS. 2 and 5) are mounted on the support member 3 at the second pair of edges 7 and 8, respectively, thereof for releasably retaining the covers of the book 27 in abutment with the surface 4 of said support member.

A lamp 30 (FIGS. 2, 3 and 5) is mounted on the support member 3 at the upper edge 5 thereof for illuminating the book 27.

A page clamp device is provided for holding the book 27 open at any desired page thereof. The page clamp device comprises a plurality of independent page clamps 31, 32, 33, and so on (FIGS. 2, 3 and 5). Each of the page clamps 31, 32, 33, and so on, is of substantially L-shape and is movably mounted in the ledge 24 for movement in directions parallel to the first pair of edges 5 and 6 and the surface 4 of the support member 3, in proximity with said surface.

Each of the page clamps 31, 32, 33, and so on, has a first arm 34, 35, 36, and so on (FIG. 5), extending substantially parallel to the surface 4 of the support member 3 from the second ledge surface 26 and a second arm 37, 38, 39, and so on (FIG. 3) extending substantially perpendicular to the surface 4 of the support member 3 from the first ledge surface 25 for facilitating manual positioning of the page clamps.

Spherical type knobs are provided at the free ends of the second arms of the page clamps 31, 32, 33, and so on, to facilitate manual gripping thereof.

Figure 4:
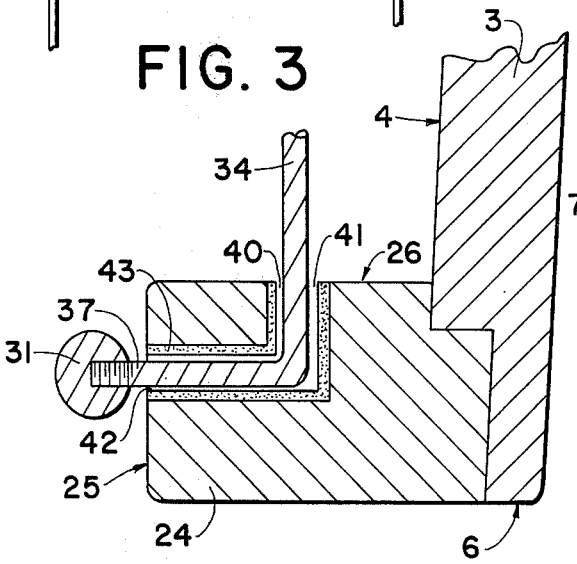
FIG. 4 is a cross-sectional view, on an enlarged scale, of part of the book holding device of the invention.

The ledge 24 may comprise a solid member, in which case an L-shaped channel 40 is formed therein extending longitudinally thereof and having a top slot opening 41 in the ledge surface 26 extending parallel to the ledge surface 25 and a side slot opening 42 in the ledge surface 25 extending parallel to the ledge surface 26, as shown in FIG. 4. The channel 40 is preferably lined with felt material 43 (FIG. 4) to facilitate movement of the page clamps therein.

While the invention has been described by means of a specific example and in a specific embodiment, I do not wish to be limited thereto, for obvious modifications will occur to those skilled in the art without departing from the spirit and scope of the invention.

I claim:

1. A book holding device for a bed having a headboard, said book holding device comprising a substantially plate-like support member of substantially rectangular configuration having a surface, a first pair of substantially parallel edges and a second pair of substantially parallel edges substantially perpendicular to and shorter than the first pair of edges bounding the surface;

mounting means swivelly affixed to the support member at an upper of the first pair of edges and swivelly affixed to the headboard of a bed for adjustably selectively positioning said support member relative to the headboard;

ledge means extending from the surface of the support member along a lower of the first pair of edges and having a first ledge surface substantially parallel to and spaced from the surface of the support member and a second ledge surface substantially perpendicular to the surface of the support member and extending from said surface to the first ledge surface for supporting a book resting on the support member in open position, said ledge having a substantially L-shaped channel formed therein and extending longitudinally thereof, said channel having a top slot opening in the second ledge surface, said top slot being parallel to the first ledge surface, and a side slot opening in the first ledge surface ,said side slot being parallel to the second ledge surface;

cover clamps mounted on the support member at the second pair of edges thereof for releasably retaining the covers of the book in abutment with the surface of said support member; and page clamp means including a plurality of independent page clamps of substantially L-shape movably mounted in the ledge means for movement in directions parallel to the first pair of edges in proximity with the surface of the support member, each of the page clamps having a first arm movably mounted in the part of the channel opening in the second ledge surface and extending substantially parallel to the surface of the support member from the second ledge surface and a second arm movably mounted in the part of the channel opening in the first ledge surface and extending substantially perpendicular to said surface from the first ledge surface for facilitating manual positioning of said page clamps.

2. A book holding device as claimed in claim 1, further comprising a lamp mounted on the support member at the upper of the first pair of edges for illuminating the book.

* * * * *